US005588214A

United States Patent [19]

Nelson

[11] Patent Number: 5,588,214

[45] Date of Patent: Dec. 31, 1996

[54] SELF DEFENSE RING

[76] Inventor: Joe B. Nelson, 2012 Ogden La., Lancaster, Calif. 93535

[21] Appl. No.: 541,328

[22] Filed: Oct. 10, 1995

[51] Int. Cl.[6] ..... B26B 27/00

[52] U.S. Cl. ..... 30/368; 30/298

[58] Field of Search ..... 30/291, 296.1, 30/298, 366, 368; 222/80, 83; 7/121; 63/1.1, 15; 42/1.08, 1.09

[56] References Cited

U.S. PATENT DOCUMENTS

| | | | |
|---|---|---|---|
| 574,520 | 1/1897 | Bray | 30/298 |
| 579,655 | 3/1897 | Saladee et al. | 30/298 |
| 3,648,371 | 3/1972 | Petrosky | 30/298 |
| 5,301,432 | 4/1994 | Richardson et al. | 30/298 |

FOREIGN PATENT DOCUMENTS

| | | | |
|---|---|---|---|
| 584919 | 11/1924 | France | 30/298 |
| 11023 | of 1898 | United Kingdom | 30/298 |

*Primary Examiner*—Hwei-Siu Payer

[57] ABSTRACT

A self defense ring assembly comprising a pair of rings integrally joined together which are receivable on two juxtaposed fingers of a user. A center portion which connects the two rings includes a hollow interior which houses a manually retractable blade. The blade may be manually deployed released to extend outwardly between the rings so as to facilitate its use for defensive purposes.

7 Claims, 3 Drawing Sheets

SELF DEFENSE RING

BACKGROUND OF THE INVENTION

1. Field of the Invention

The present invention relates to self defense devices and more particularly pertains to a self defense ring for deterring an assailant.

2. Description of the Prior Art

The use of rings which can be worn on the hands of a user and which can be employed for self defense purposes is known in the prior art. For example, U.S. Pat. No. 4,135,645, which issued to Kimmell on Jan. 23, 1979, discloses a self defense ring which has an opening for inserting a finger therethrough. The ring further includes a piercing member removably affixed to or integral with the ring member, and being positioned beneath a decorative sphere which contains a debilitating chemical substance. Upon striking an assailant, the sphere ruptures as a result of the piercing member coming into contact with it, and the chemical substance is released so as to hopefully provide a debilitating effect.

As opposed to using a chemical substance, U.S. Pat. No. 3,648,371, which issued to Petrosky on Mar. 14, 1972, discloses a ring having the appearance of a wedding band and which includes an inward and downward pointed triangular blade having sharpened cutting edges. The blade is permanently affixed to the ring and is always in an outwardly extended position. In case of attack, a person wearing the ring simply touches the point to the clothing or skin of the attacker, and by pulling away, rips the clothing or skin so that the attacker may be later identified.

Another self defense ring which utilizes a sharpened blade is to be found in U.S. Pat. No. 5,301,432 which issued to Richardson et al. on Apr. 12, 1994. This ring includes a crown member having an elongate slot formed therein with a sharpened blade member being arranged in the slot. First and second pin members are provided to pivot the blade member from a retracted position, whereby the blade is located in the slot, to an extended position, whereby the blade is exposed. The blade member is connected to the top section of the crown by one of the pin members and is connected to the crown member by the other pin member. Movement of crown member towards the top section causes the pin members to pivot the blade member to an extended position.

Each of these above-described self defense rings is functional for its intended purpose, and they all provide a reliable self defense capability. However, they all rely upon a ring assembly which is positionable over a single finger of a user and during an altercation with an assailant, the possibility exists that such ring members could rotate upon the ring of a wearer whereby injury could result to the wearer or no injury at all might occur to the assailant. While the self defense ring identified in the Petrosky patent does disclose the use of a stabilizing bar integrally attached to the ring so as to prevent ring rotation, the Petrosky ring utilizes a blade which is continuously exposed so as to potentially provide discomfort to a wearer.

Accordingly, there would appear to exist the need for improvements in self defense rings whereby a greater degree of stability could be achieved in holding a ring in a desired position while at the same time providing for a defensive device, such as a sharpened blade, which could be retracted or removed when not needed. In this respect, the present invention substantially fulfills this need.

SUMMARY OF THE INVENTION

In view of the foregoing disadvantages inherent in the known types of self defense rings now present in the prior art, the present invention provides a new self defense ring construction wherein the same can be utilized for both aesthetic and self defense purposes. As such, the general purpose of the present invention, which will be described subsequently in greater detail, is to provide a new self defense ring apparatus and method which has many of the advantages of the self defense rings mentioned heretofore and many novel features that result in a self defense ring construction which is not anticipated, rendered obvious, suggested, or even implied by any of the prior art self defense rings, either alone or in any combination thereof.

To attain this, the present invention generally comprises a self defense ring assembly comprising a pair of rings integrally joined together which are receivable on two fingers of a user. A center portion which connects the two rings includes a hollow interior which houses a manually retractable blade. The blade may be released to extend outwardly between the rings so as to facilitate its use for defensive purposes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new self defense ring assembly and method which has many of the advantages of the self defense devices mentioned heretofore and many novel features that result in a self defense ring which is not anticipated, rendered obvious, suggested, or even implied by any of the prior art self defense devices, either alone or in any combination thereof.

It is another object of the present invention to provide a new self defense ring assembly which may be easily and efficiently manufactured and marketed.

It is a further object of the present invention to provide a new self defense ring assembly which is of a durable and reliable construction.

An even further object of the present invention is to provide a new self defense ring assembly which is susceptible of a low cost of manufacture with regard to both materials and labor, and which accordingly is then susceptible of low prices of sale to the consuming public, thereby making such self defense rings economically available to the buying public.

Still yet another object of the present invention is to provide a new self defense ring assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
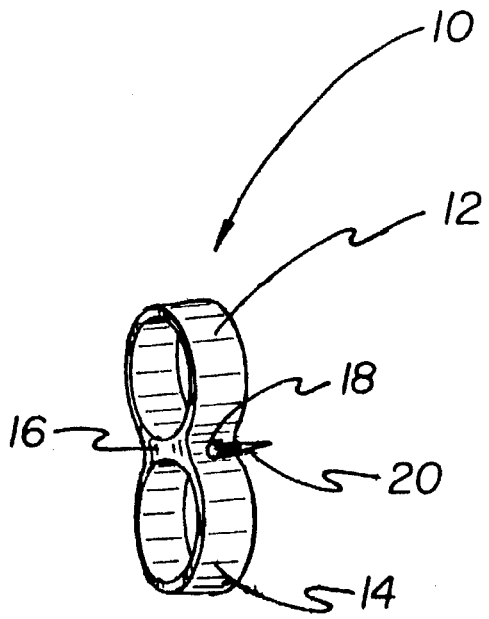
FIG. 1 is a bottom perspective view of a self defense ring assembly according to the present invention.

With reference now to the drawings, and in particular to FIGS. 1–4 thereof, a new self defense ring assembly embodying the principles and concepts of the present invention and generally designated by the reference numeral 10 will be described.

Figure 2:
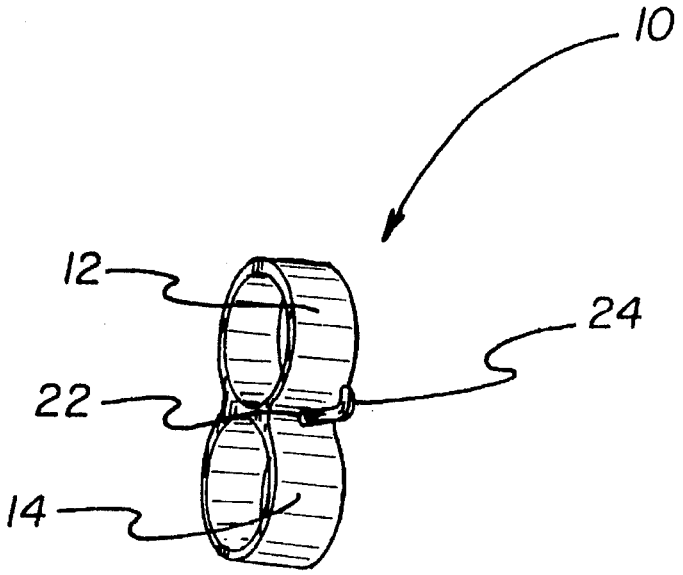
FIG. 2 is a top perspective view of the present invention.
Figure 3:
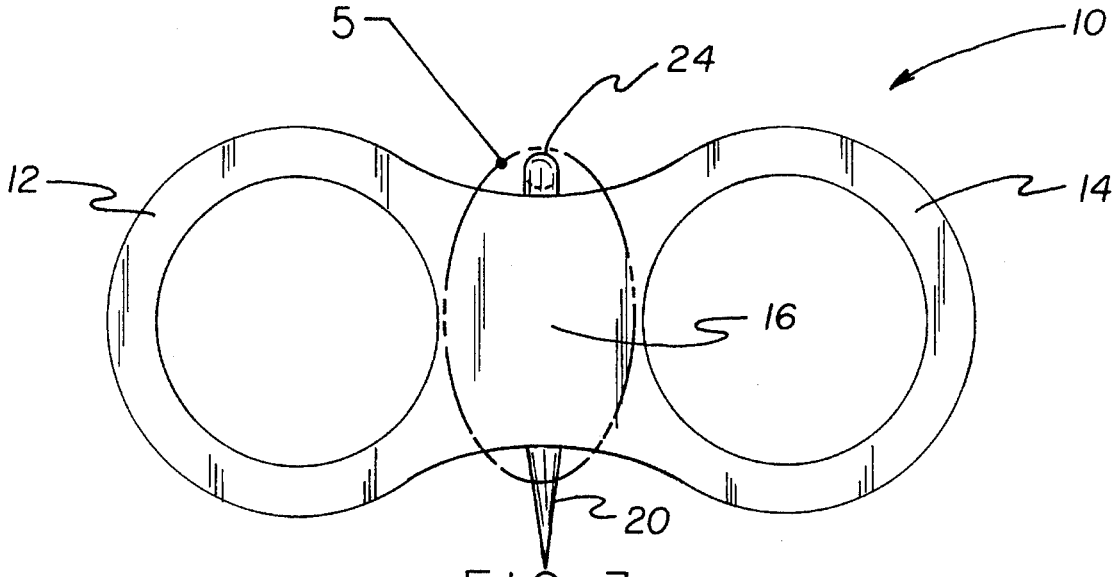
FIG. 3 is a front elevation view of the invention.
Figure 4:
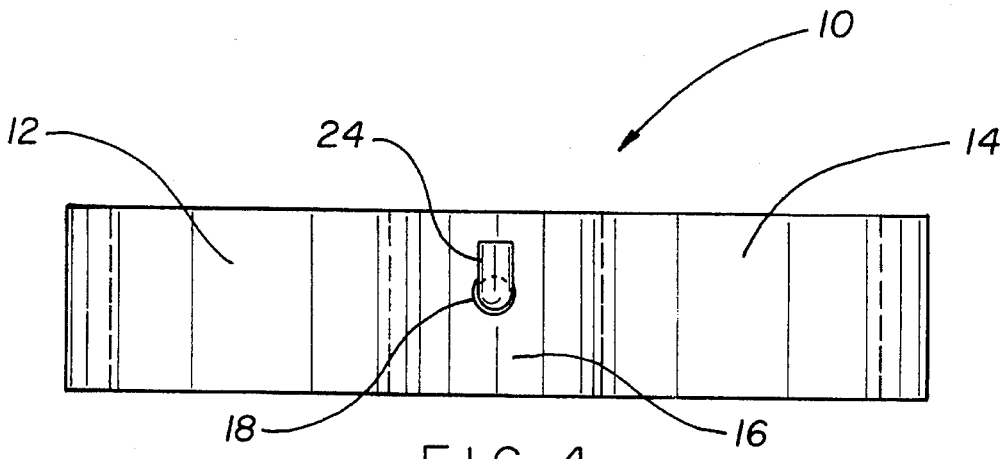
FIG. 4 is a top plan view of the invention.

More specifically, it will be noted that the self defense ring assembly 10 essentially comprises a pair of rings 12, 14 which are parallely aligned and integrally joined together by a center section 16. The center section 16 is of a hollow construction and as shown in FIG. 1, it includes an aperture 18 through which a blade 20 may be selectively extended. As shown in FIG. 2, a top portion of a center section 16 includes a second aperture 22 through which a release lever 24 extends outwardly.

Figure 5:
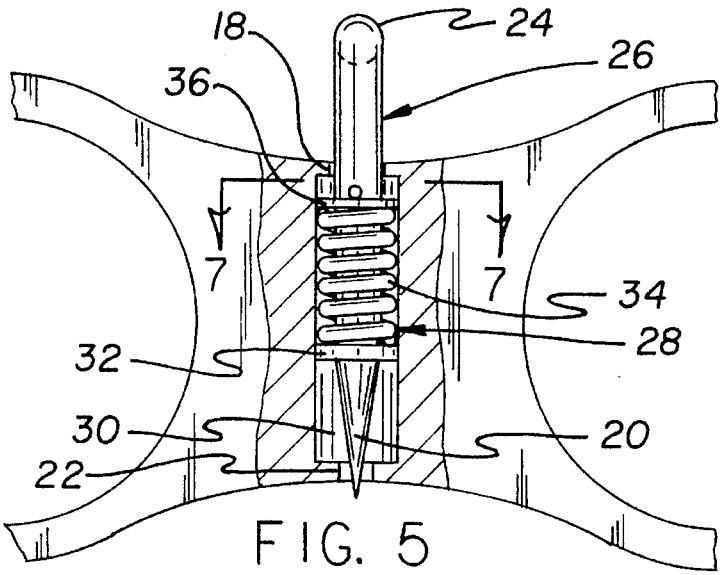
FIG. 5 is a partial detail view in the region indicated as 5 in FIG. 3, of the blade assembly forming a part of present invention and showing the same in a retracted position.
Figure 6:
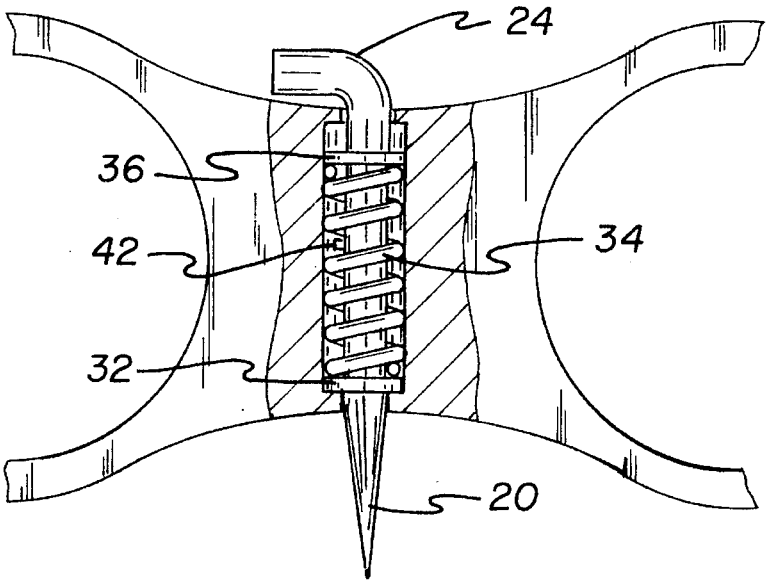
FIG. 6 is a partial detail view of the blade assembly shown in FIG. 5 and showing the same in an extended position.

As best illustrated in FIGS. 5 and 6, the release lever 24 and blade 20 are formed as a single integral, elongate member which is generally designated by the reference numeral 26 and which is part of a retractable blade assembly 28. The retractable blade assembly 28 is substantially positioned within a cylindrically shaped cavity 30. The retractable blade assembly 28 includes a washer member 32 which is positioned over the elongate member 26 and which is permanently affixed thereto by some conventional attachment means, such as by welding or the like. The washer member 32 is of a diameter which conformingly fits within the cavity 30 and is slidably moveable along the axial length of the cavity concurrently with movement of the elongate member 26.

The retractable blade assembly 28 further includes a compressible spring 34 which is positioned around and along the axial length of the elongate member 26. The spring 34 substantially conforms in diameter to the diameter of the cavity 30 and is slidably moveable therewithin. The spring 34 is compressible between the washer member 32 and a second washer member 36 which is of a diameter that conforms to the diameter of the cavity 30 and which is fixedly secured along its circumferential edge to an interior wall portion of the cavity, with such securement being achieved by some conventional attachment means, such as by welding or the like.

Figure 7:
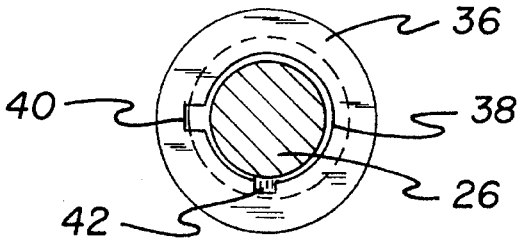
FIG. 7 is a cross sectional view of the invention as viewed along the line 7—7 of FIG. 5.

With particular reference to FIG. 7, it can be seen that the second washer member 36 is designed to be permanently secured in a fixed position within the cavity 30 and has an interior aperture 38 which is of a diameter that facilitates slidable movement of the elongate member 26 therethrough. The aperture 38 is also provided with a rectangular through-extending slot 40, while the elongate member 26 is provided with an integral outwardly extending detent 42 which is of a size that will permit it to slidably move through the slot 40. Rotatable and axial movement of the elongate member 26 within the cavity 30 is facilitated by the aforementioned apertures 18, 22 which are formed in the center section 16 and which are in fluid communication with the cavity.

In use, it can be seen that the ring assembly 10 may be positioned over the second and third fingers respectively, of a wearer The use of two integrally attached rings 12, 14 provides for increased stability of the entire assembly 10 inasmuch as neither of the rings can rotate relative to one another, thereby to prevent a self-inflicted injury. With the retractable blade assembly 28 normally retracted, the release lever 24 will be in an extended outward position as illustrated in FIG. 2, while the blade 20 will be substantially retained with the cavity 30 as shown in FIG. 5. If the wearer suddenly becomes the intended victim of an assailant, the wearer need only to grasp the release lever 24 and rotate it within the aperture 38 until the detent 42 is in alignment with the slot 40. When this occurs, the compressed spring 34 will force the blade 20 outwardly through the aperture 22 since the elongate member 26 will be released for axial movement within the cavity 30. By a sharp motion of the hand, the wearer will then be able to inflict a minor wound on the assailant to discourage any further attack therefrom. When the attack is over, the blade 20 may be easily retracted into the cavity 30 and the elongate member 26 may again be rotated to facilitate a locking of the blade in the retracted position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved self defense ring assembly comprising:

ring means positionable on the hand of a user, said ring means including at least two ring members positionable over at least two fingers of said user, said at least two ring members being fixedly attached together by a center section, said center section includes a hollow interior portion;

and blade assembly means forming a part of said ring means and including a retractable blade utilizable for self defense purposes, said blade assembly means being substantially retained within said hollow interior portion.

2. The new and improved self defense ring assembly as described in claim 1, wherein said blade is selectively releasable out of said hollow interior portion and said blade assembly means further includes a release lever positioned on a top portion of said center section.

3. The new and improved self defense ring assembly as described in claim 2, wherein said blade and said release lever are integrally formed as an elongate member slidably moveable within said hollow interior portion.

4. The new and improved self defense ring assembly as described in claim 3, wherein slidable movement of said elongate member is facilitated by a compression spring retained within said hollow interior portion.

5. The new and improved self defense ring assembly as described in claim 4, wherein said compression spring is retained between a first washer member fixedly secured to said elongate member and a second washer member fixedly secured to said hollow interior portion, said elongate member being slidably movable through said second washer member.

6. The new and improved self defense ring assembly as described in claim 5, and further including locking means for retaining said blade within said hollow interior portion against a releasing force provided by said compression spring.

7. The new and improved self defense ring assembly as described in claim 6, wherein said locking means includes a slot formed in said second washer member and an outwardly extending detent formed on said elongate member, said detent being alignable with said slot and being moveable therethrough in response to a moving force provided by said compression spring during an unlocking of said elongate member within said hollow interior portion, thereby to facilitate a movement of said blade into an outwardly extending, useable position relative to said ring means.

* * * * *